US007114297B2

(12) United States Patent
Mathis et al.

(10) Patent No.: US 7,114,297 B2
(45) Date of Patent: Oct. 3, 2006

(54) RADIUS CORNER PLATE FOR A POOL

(75) Inventors: Wesley L. Mathis, Draper, UT (US); David B. Dalton, Heber City, UT (US)

(73) Assignee: Pool Cover Specialists National, Inc., West Jordan, UT (US)

( * ) Notice: Subject to any disclaimer, the term of this patent is extended or adjusted under 35 U.S.C. 154(b) by 72 days.

(21) Appl. No.: 10/347,161

(22) Filed: Jan. 16, 2003

(65) Prior Publication Data

US 2003/0213195 A1 Nov. 20, 2003

Related U.S. Application Data

(60) Provisional application No. 60/361,187, filed on Feb. 28, 2002, provisional application No. 60/349,894, filed on Jan. 16, 2002.

(51) Int. Cl.
*E02D 27/00* (2006.01)

(52) U.S. Cl. ..... 52/169.7; 52/287.1; 52/102; 4/488; 4/496; 4/503

(58) Field of Classification Search ..... 52/169.7, 52/191, 182, 287.1, 102, 85, 86; 4/496, 488, 4/499, 506, 507, 498, 503, 510
See application file for complete search history.

(56) References Cited

U.S. PATENT DOCUMENTS 1,782,147 A * 11/1930 Merryweather ..... 52/85
2,442,929 A * 6/1948 Marino ..... 52/85
3,524,291 A * 8/1970 Rozanski ..... 52/169.7
3,835,481 A * 9/1974 Engelhart et al. ..... 52/169.7
3,950,907 A 4/1976 Dahowski
3,967,422 A 7/1976 Stegmeier
3,986,309 A 10/1976 Coulter
4,008,547 A * 2/1977 Katzman ..... 52/169.7
4,086,739 A 5/1978 Hall
4,167,084 A 9/1979 Brunton
4,297,819 A 11/1981 Arp
4,457,119 A 7/1984 Dahowski
4,601,073 A 7/1986 Methot
4,603,521 A 8/1986 Engelhart
4,665,666 A * 5/1987 Hampton ..... 52/86
4,765,775 A * 8/1988 Kroger ..... 405/52
5,092,090 A 3/1992 Stump
5,134,730 A * 8/1992 Vandis ..... 4/504
5,134,819 A * 8/1992 Boyack ..... 52/169.7
5,454,195 A * 10/1995 Hallsten ..... 52/169.1
5,488,745 A 2/1996 Barrera
5,524,399 A * 6/1996 Reum et al. ..... 52/169.7

(Continued)

*Primary Examiner*—Daniel P. Stodola
*Assistant Examiner*—Nahid Amiri
(74) *Attorney, Agent, or Firm*—Clayton, Howarth & Cannon, P.C.

(57) ABSTRACT

A modular rounded corner piece for forming rounded corners of a pool. The modular rounded corner piece may include a plate portion and a liner receptor portion. The liner receptor portion may include a channel formed by a top wall and a bottom wall. The channel may align with a pool liner receptor slot in the coping around the perimeter of the pool. Thus, a continuous liner receptor slot may be formed around the interior circumference of the pool for receiving an edge of a pool liner thereinto. The modular rounded corner piece may be installed on the pool sidewall to provide a gapless alignment between the liner receptor on the pool sidewall and the liner receptor in the rounded side of the corner plate.

36 Claims, 5 Drawing Sheets

U.S. PATENT DOCUMENTS 5,572,834 A * 11/1996 Lilly ..... 52/85
5,819,485 A * 10/1998 Lane et al. ..... 52/287.1
5,916,099 A 6/1999 Hall
6,128,864 A * 10/2000 Barry et al. ..... 52/86
6,195,945 B1 * 3/2001 McGarry et al. ..... 52/88
6,357,058 B1 * 3/2002 Biancamano ..... 4/496
6,389,757 B1 * 5/2002 DeGarie ..... 52/63
6,457,189 B1 * 10/2002 Kindness ..... 4/506
6,662,383 B1 * 12/2003 Cornelius et al. ..... 4/506
2001/0047540 A1 12/2001 Perrier
2003/0084619 A1 * 5/2003 Smith
2003/0097709 A1 * 5/2003 Smith
2003/0145373 A1 * 8/2003 Mathias
2003/0190192 A1 * 10/2003 Cain et al.

* cited by examiner

RADIUS CORNER PLATE FOR A POOL

CROSS-REFERENCE TO RELATED APPLICATIONS

This application claims the benefit of U.S. Provisional Application No. 60/349,894, filed Jan. 16, 2002, and U.S. Provisional Application No. 60/361,187, filed Feb. 28, 2002, which applications are hereby incorporated by reference herein in their entireties, including but not limited to those portions that specifically appear hereinafter, the incorporation by reference being made with the following exception: In the event that any portion of the above-referenced provisional applications is inconsistent with this application, this application supercedes said above-referenced provisional applications.

STATEMENT REGARDING FEDERALLY SPONSORED RESEARCH OR DEVELOPMENT

Not Applicable.

BACKGROUND OF THE INVENTION

1. The Field of the Invention

The present invention relates generally to swimming pool components, and more particularly, but not necessarily entirely, to a modular rounded corner piece for use in the construction of a swimming pool.

2. Description of Related Art

Swimming pools can be formed to have a variety of different configurations. One known variety of swimming pool includes a sidewall covered with a liner attachment. An upper, free end of the liner is received in a circumferential liner slot located near the top of the pool which extends entirely around the pool's perimeter. It is common practice to form the swimming pools in various shapes to enhance the aesthetic and functional aspects of the pool. For example, some swimming pools have side walls that meet at ninety degree corners. Other swimming pools have rounded corners which present a better aesthetic appearance to some observers than the ninety degree corners.

Swimming pool designers have had difficulties in designing liner-pools with rounded corners in an economic manner that function properly and have a pleasant appearance. For example, rounded corner pieces previously installed in swimming pools have been difficult to match and align with the liner slot on the adjacent sides of the swimming pool. The rounded corner pieces added to swimming pools have been known to create gaps between the rounded corner piece and the sidewalls and liner slots which detract from the appearance of the corner.

In view of the drawbacks inherent in the available art, it would be a significant advancement in the art to provide a modular corner piece with a liner receiving channel for use in constructing curved or rounded corners of a pool. It would be a further advancement in the art to provide such a modular corner piece that is simple in design and manufacture. It would also be an improvement in the prior art to provide such a corner piece that provides for alignment of the liner receiving channel with the liner slots recessed in the pool walls. It would be an additional advancement in the art to provide a modular rounded corner piece for a pool that avoids producing gaps between the liner receiving channel and the liner slots in the pool walls, and which provides a corner with an aesthetically pleasant appearance.

The prior art is thus characterized by several disadvantages that are addressed by the present invention. The present invention minimizes, and in some aspects eliminates, the above-mentioned failures, and other problems, by utilizing the methods and structural features described herein.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the invention will become apparent from a consideration of the subsequent detailed description presented in connection with the accompanying drawings in which.

DETAILED DESCRIPTION OF THE INVENTION

Figure 1:
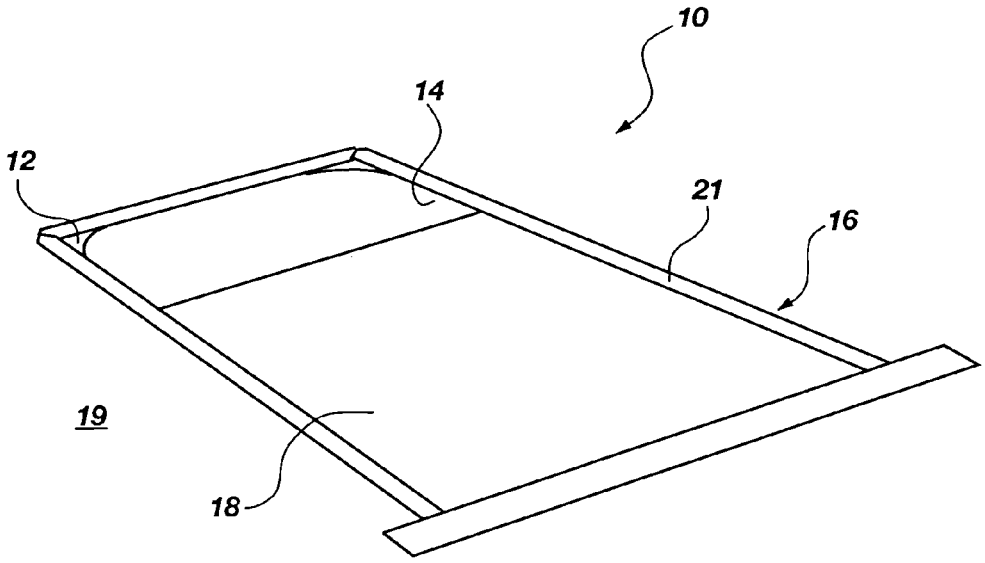
FIG. 1 is a perspective view of a swimming pool including a modular rounded corner of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It must be noted that, as used in this specification and the appended claims, the singular forms "a," "an," and "the" include plural referents unless the context clearly dictates otherwise.

As used herein, "comprising," "including," "containing," "characterized by," and grammatical equivalents thereof are inclusive or open-ended terms that do not exclude additional, unrecited elements or method steps.

Referring now to FIG. 1, a perspective view of a swimming pool is shown, indicated generally at 10. The swimming pool 10 may include a modular corner piece 12, in accordance with the principles of the present invention, to provide rounded corners on the pool 10. The pool 10 may also include sidewalls 14 covered with a coping member 16 defining the perimeter of the pool 10. The pool 10 may further include a retractable pool cover 18 to prevent the collection of debris and leaves in the swimming pool 10. The pool cover 18 may help reduce the frequency and amount of pool maintenance that would otherwise be required. In addition, the retractable pool cover 18 may provide a significant safety benefit in that the weight of a person may be supported by the pool cover 18 while the pool cover 18 is extended over the water, to prevent unwanted access to the pool 10 or drowning while the pool 10 is unattended. Furthermore, the retractable pool cover 18 may be beneficial in reducing heat loss and actually increasing water temperature through solar heating.

The modular corner piece 12 and coping member 16 of the present invention may be configured to be compatible with the pool cover 18 to allow the pool 10 to have a pleasant appearance. It will be appreciated that pools of various sizes and configurations may be used within the scope of the present invention.

The pool 10 may be surrounded by a deck 19 formed of concrete, wood, or any other material known in the art. It will be appreciated that the deck 19 may be formed at the surface of the ground or at an elevated position with respect to the ground level within the scope of the present invention.

Figure 2:
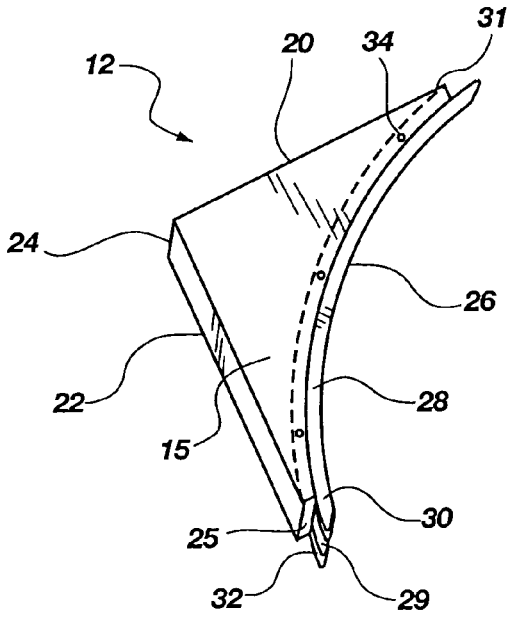
FIG. 2 is a perspective view of an exemplary embodiment of a modular corner of FIG. 1.

Referring now to FIG. 2, a perspective view of an exemplary embodiment of the modular corner piece 12 of the present invention is shown. The modular corner piece 12 may include a corner plate 15 which may be formed as a substantially planar member having a first side 20 and a second side 22. The first side 20 and the second side 22 may meet in a corner point 24. In one embodiment, the first side 20 and the second side 22 may form a ninety degree corner, however it will be appreciated that the first side 20 and the second side 22 may have other angular relationships to conform to the configuration of the pool 10.

Figure 3:
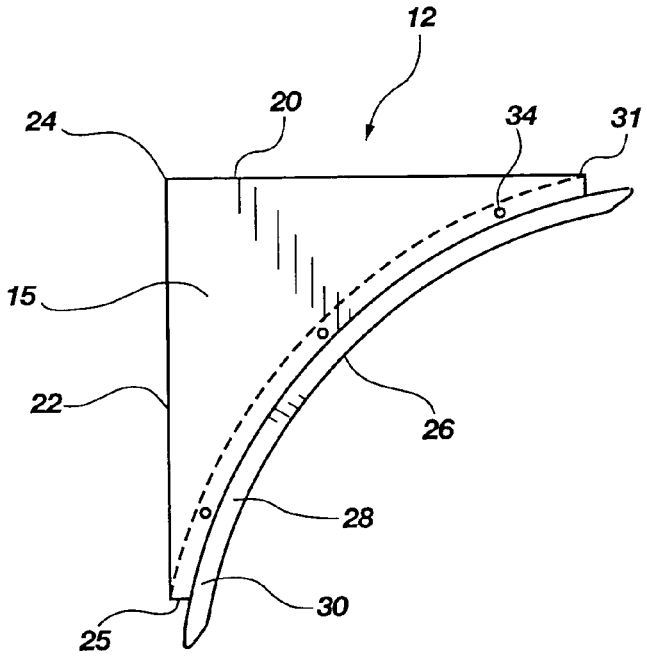
FIG. 3 is a plan view of an exemplary embodiment of the modular corner of FIG. 2.

The modular corner piece 12 also may include a curved portion or side 26 having any desired radius of curvature, such as six inches, twelve inches, eighteen inches, or twenty-four inches for example. It will be appreciated that the curved portion 26 may have any radius of curvature within the scope of the present invention. Moreover, the curved portion 26 may have a curvature that includes multiple curves having different radii of curvatures. It is also contemplated that the side 26 may have linear shaped portions within the scope of the present invention. The curved portion 26 may include a liner receptor portion 28 forming a channel 29 between a top wall 30 and a bottom wall 32. The liner receptor portion 28 may be curved and include a flange 31, shown in dashed lines in FIGS. 2 and 3. The flange 31 may be attached to a bottom side of the modular corner piece 12, a top side of the modular corner piece 12, or both the top and bottom sides of modular corner piece 12. The flange 31 may be attached to the corner plate 15 using fasteners 34 such as rivets, screws, or bolts for example. Moreover, the flange 31 may be attached to the corner plate 15 using adhesives, or welding or any other manner of attachment known to those skilled in the art within the scope of the present invention.

The first side 20 and the second side 22 may each have a shoulder 25 defining an end of the corner plate 15. The liner receptor portion 28 may be configured and dimensioned to extend a distance beyond the shoulder 25 such that the channel 29 may extend beyond the corner plate 15.

Figure 4:
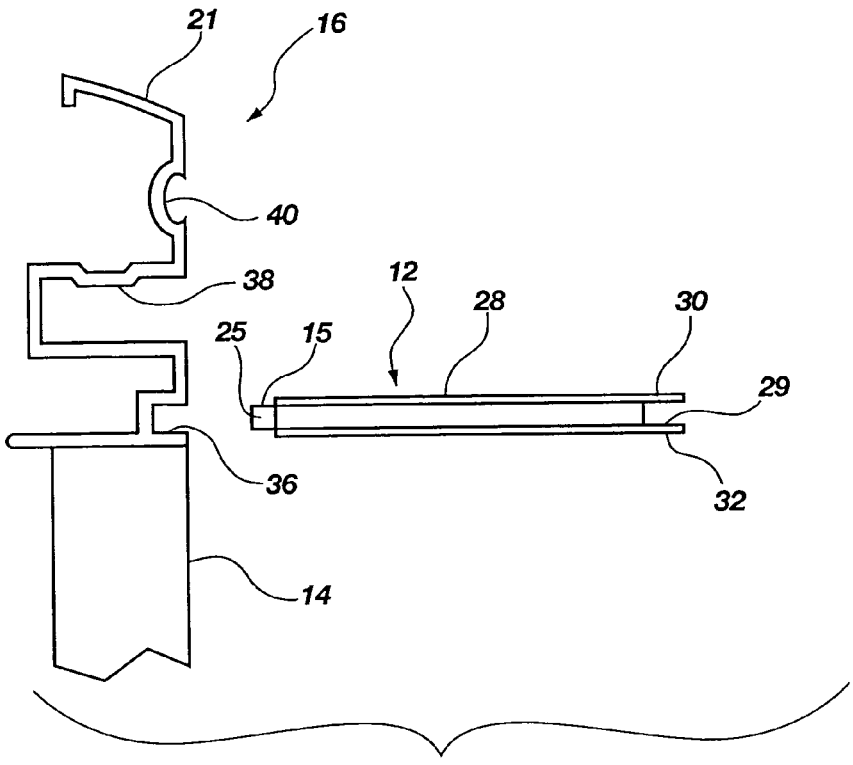
FIG. 4 is side view of the modular corner of FIG. 3 and a break-away end view of a pool sidewall having a liner receptor slot.

Installation of the modular corner piece 12 will now be explained with particular reference to FIG. 4, which shows a side view of the modular corner piece 12, and a breakaway end view of the pool sidewall 14. The coping member 16 on the top of pool sidewall 14 may include a pool liner receptor slot 36 for receiving a pool liner, such as a vinyl liner (not shown), in any suitable manner known in the art. The coping member 16 further includes an upper portion 21 that may be decoratively shaped if desired. The coping member 16 may also include a track retainer 38 which may serve to retain a pool cover track for guiding an edge of the retractable pool cover 18, and a lighting channel 40 for housing lighting devices such as fiber optics. The track retainer 38 and lighting channel 40 are optional, and need not be included as part of the pool sidewall 14. The coping member 16, including the track retainer 38 and the liner holder 36 may be formed of a single piece, thereby facilitating installation as compared to the prior art devices that require assembly of the separate components. The one-piece coping member 16, track retainer 38 and liner holder 36 may be positioned on top of the pool sidewall 14 and concrete may be placed behind the coping member 16 to form a pool deck 19 having an aesthetically pleasing appearance. It will be appreciated that various configurations of coping member 16 and pool side walls 14 may be used with the modular corner piece 12 within the scope of the present invention. Moreover, it will be appreciated that in one embodiment of the present invention, the liner holder 36 may be formed in the pool sidewall 14 without the coping member 16, for use with the modular corner piece 12.

Figure 5:
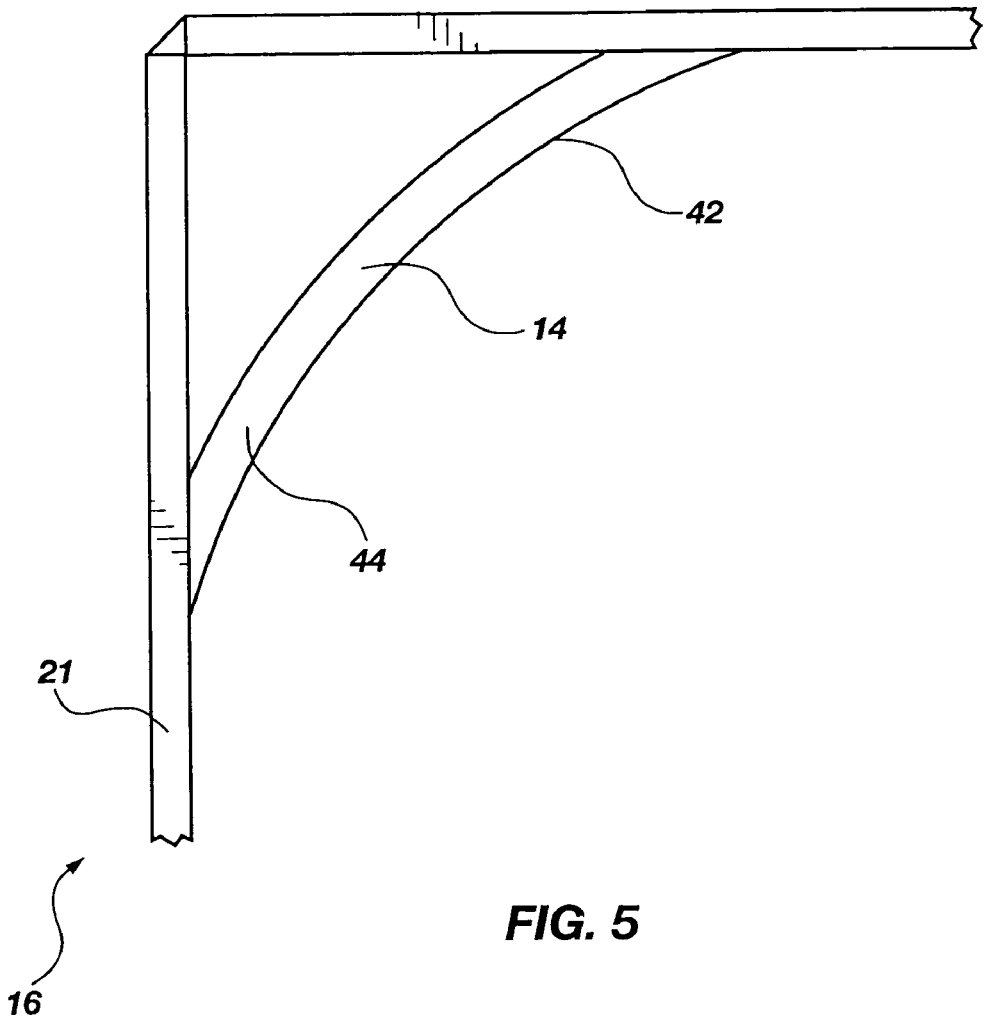
FIG. 5 is a break-away top view of a corner of a swimming pool, including a view of a rounded pool sidewall corner, prior to installation of the radius cover plate of the present invention.

The modular corner piece 12 may be installed by inserting the first side 20 and the second side 22 of the corner plate 15 into the pool liner receptor slot 36 in a corner of the pool 10. The modular corner piece 12 may be pressed into the pool liner receptor slot 36 until the curved portion 26 is flush with an interior surface 42 of pool sidewall 14, as shown in FIG. 5. The modular corner piece 12 may be held by friction in the pool liner receptor slot 36. Also, a holding force may be imposed on the modular corner piece 12 by the liner (not shown) when the liner is inserted into the liner receptor portion 28, which may help to hold the modular corner piece 12 in place. The modular corner piece 12 may be attached even more rigidly if desired by placing an adhesive or silicone bead, for example, on the bottom of the modular corner piece 12 to fix the modular corner piece 12 to a top surface 44 of the sidewall 14. Moreover, an adhesive or silicone bead may also be placed in the pool liner receptor slot 36 if desired to more firmly attach the modular corner piece 12 to the pool liner receptor slot 36 in one embodiment of the present invention.

When the modular corner piece 12 is properly positioned, the channel 29 of the curved liner receptor portion 28 aligns with the pool liner receptor slot 36. Thus, the alignment is easily accomplished. The liner receptor portion 28 on the modular corner piece 12 creates a straight "feed" into the pool liner receptor slot 36 so that binding of the liner may be prevented. Furthermore, since the modular corner piece 12 may be inserted into the pool liner receptor slot 36, no visible gap may be present along the transition between opposing edges of the curved liner receptor 28 and their abutment with pool liner receptor 36, as is the case in the prior art devices. Therefore, the present invention provides a more aesthetic, dressed up appearance.

The modular corner piece 12 may be constructed of any suitable material known in the art such as fiberglass or other composite material, plastic, metal or wood. Also, the modular corner piece 12 may be finished so as to match the texture and color of the coping member 16.

Figure 6:
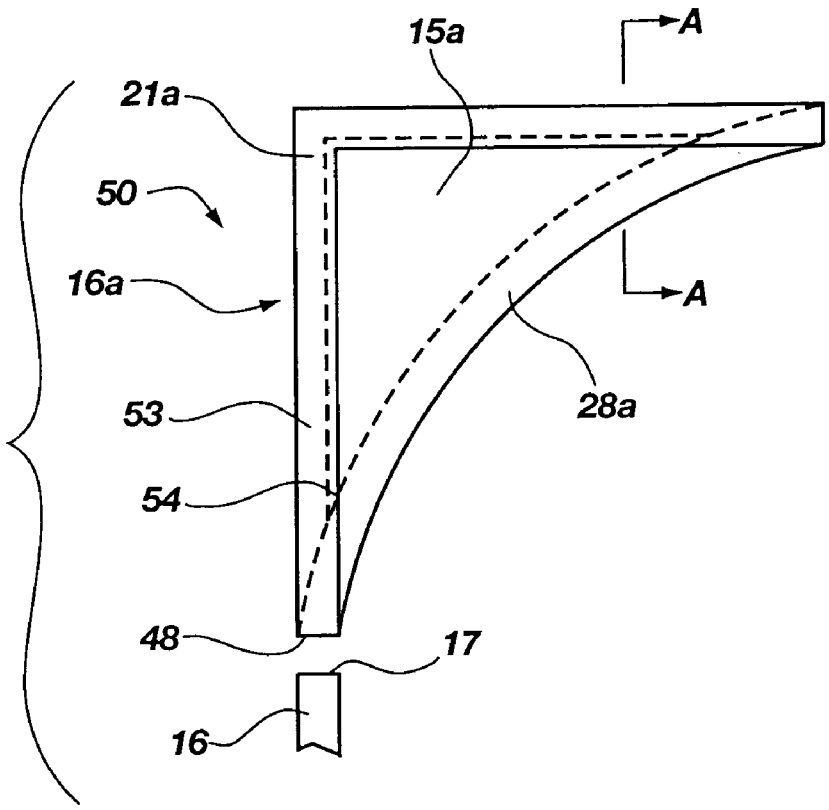
FIG. 6 is a break-away exploded plan view of an alternative embodiment of a modular corner.

Reference will now to made to FIG. 6 to describe a second embodiment of the present invention. As previously discussed, the present embodiments of the invention illustrated herein are merely exemplary of the possible embodiments of the invention, including that illustrated in FIG. 6.

It will be appreciated that the second embodiment of the invention illustrated in FIG. 6 contains many of the same structures represented in FIGS. 1–5 and only the new or different structures will be explained to most succinctly explain the additional advantages which come with the embodiments of the invention illustrated in FIG. 6.

FIG. 6 shows a plan view of an alternative embodiment of a corner piece, indicated generally at 50 and a break-away portion of the coping member 16. The corner piece 50 may include a corner plate 15*a*, an alternative curved liner receptor portion 28*a*, and a corner coping member 16*a*. The corner coping member 16*a* may include an upper portion 21*a* that may be decoratively shaped if desired. The alternative modular corner plate 15*a* and the alternative curved liner receptor portion 28*a* may be configured such that the alternative corner plate 15*a* may be inserted into a curved portion slot 46, shown in FIG. 7, of the curved liner receptor portion 28*a*. The corner piece 50 may include a linear coping portion 53 for aligning with the coping member 16, and the liner receptor portion 28*a* may be aligned with the linear coping portion 53 at the end 48. The liner receptor portion 28*a* may curve away from the linear coping portion 53 towards the opposing end of the corner piece 50 such that the liner receptor portion 28*a* becomes spatially separated from the linear coping portion 53. The linear coping portion 53 may have a cross sectional configuration that is substantially the same as a cross sectional configuration of the coping member 16 forming the straight edge of the pool 10.

Figure 8:
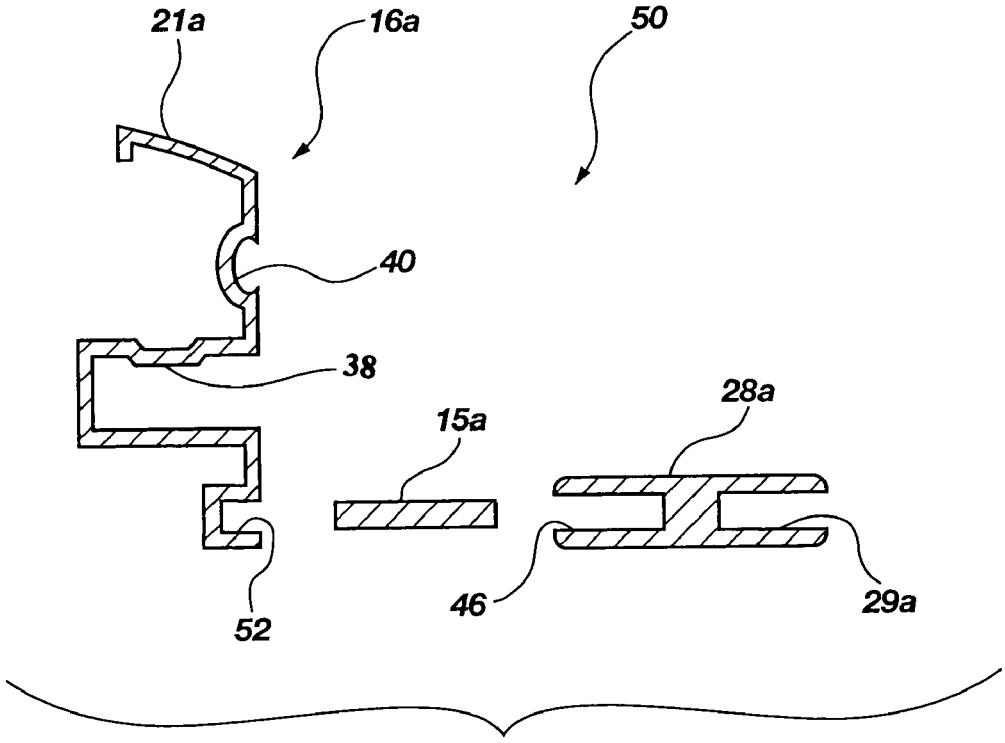
FIG. 8 is an exploded cross-sectional view of the embodiment of FIG. 6 taken along line A—A.

Referring now to FIG. 8, an exploded cross sectional view is shown of the alternative embodiment of the modular corner plate 15*a*, taken along line A—A in FIG. 6. The alternative modular corner plate 15*a* may be fixed within the slot curved portion slot 46 and to the pool sidewall 14 through the corner coping member 16*a*. The corner coping member 16*a* may be substantially rigid to hold particular shape and may include a plate slot 52 for receiving the corner plate 15*a*. The corner plate 15*a* may be fixed in the plate slot 52 by welding, adhesives, fasteners, friction, or any other manner known in the art, so that the corner piece 50 forms a single unit including the corner plate 15*a*, and the liner receptor portion 28*a*, and the corner coping member 16*a*. It will further be appreciated that the corner coping member 16*a*, the corner plate 15*a*, and the liner receptor portion 28*a* may be molded or formed integrally as a single unit without the need for attaching by welding, adhesives, fasteners or friction.

Figure 7:
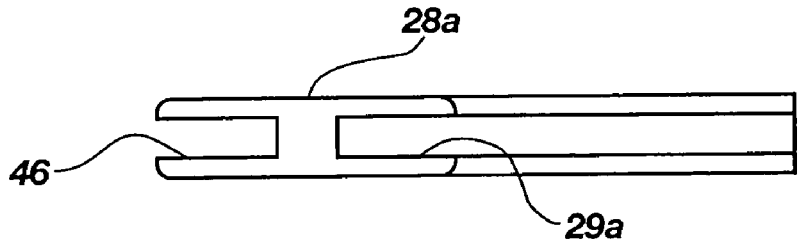
FIG. 7 is an end view of a liner receptor portion of the alternative embodiment of the FIG. 6.

Unlike the first embodiment of the present invention, the alternative embodiment of the modular corner piece 50 shown in FIGS. 6–8 does not fit within the pool liner receptor slot 36. Rather, ends 48 of the corner piece 50 abut with straight portion coping ends 17 of the coping member 16 such that the pool liner receptor slot 36 aligns with the channel 29*a* of the alternative curved liner receptor portion 28*a*. It will be appreciated that the corner coping member 16*a* may be cut away at the intersection 54 between the liner receptor portion 28*a* and the corner coping member 16*a* so that the channel 29*a* extends to the end 48 of the corner piece 50 such that the opposing free ends of the channel 29*a* are disposed in elevational and directional alignment with and beneath opposing free ends of the corner coping member 16*a*, and in lateral alignment with the pool liner receptor slot 36.

It will also be appreciated that the curved liner receptor portion 28*a* may intersect the corner coping member 16*a* away from the end 48 and that various different shapes and curvatures may be formed by the liner receptor portion 28*a* and the corner plate 15*a* within the scope of the present invention.

It will be appreciated that the components of the present invention discussed above can be mass produced in a factory setting so that manufacturing costs can be reduced and high manufacturing standards can be achieved. Furthermore, different components of the present invention can be combined as a kit so that a pool system may be customized for a particular use. The kit may then be delivered to the site of the pool and easily assembled to save labor time and costs.

In accordance with the features and combinations described above, a useful method of installing a modular corner piece in a pool includes the steps of:

(a) inserting a first side of the modular corner piece in the pool liner receptor slot of the first coping member;

(b) inserting a second side of the modular corner piece in the pool liner receptor slot of the second coping member; and (c) pressing the corner piece into the pool liner receptor slot until the curved portion aligns with the pool liner receptor slot.

In view of the foregoing, it will be appreciated that the present invention provides a modular corner piece, for covering a top of a rounded pool sidewall, which is simple in design and manufacture, and which provides for alignment of the liner slot. The present invention also provides a modular corner piece for a pool which eliminates a visible gap between the corner plate and the pool sidewall, and which provides a finish cover with a aesthetically pleasant appearance.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A modular corner piece for forming a corner of a pool, said modular corner piece comprising:

a corner plate defining a substantially planar member comprising a first side and a second side, said first side and said second side intersecting at a corner point; and a curved portion including a liner receptor portion for receiving a pool liner;

wherein said curved portion extends between said first side and said second side;

wherein said curved portion defines a concave curve; and wherein said liner receptor portion comprises a top wall and a bottom wall defining a channel therebetween, and wherein said channel has a depth that is greater than a thickness of said channel between said top wall and said bottom wall.

2. The modular corner piece of claim 1, wherein said first side of said corner plate is disposed at a right angle with respect to said second side.

3. The modular corner piece of claim 1, wherein said curved portion comprises a curved portion slot for receiving said corner plate.

4. The modular corner piece of claim 1, further comprising at least one end configured for abutting with a coping end on said pool wall.

5. The modular corner piece of claim 1, wherein said corner plate has an upper surface and a lower surface and wherein said liner receptor portion extends above said upper surface.

6. The modular corner piece of claim 1, wherein said channel extends from an upper surface of said corner plate to a lower surface of said corner plate.

7. The modular corner piece of claim 4, further comprising a substantially rigid coping portion for aligning with said coping end to form a coping corner.

8. The modular corner piece of claim 4, further comprising a linear coping portion for aligning with said coping end, said liner receptor being aligned with said linear coping portion at said at least one end and curving away from said linear portion.

9. The modular corner piece of claim 5, wherein said liner receptor portion extends below said lower surface.

10. A modular corner piece for forming a corner of a pool, said pool including a sidewall having a pool liner receptor slot for receiving a pool liner, said modular corner piece comprising:

a corner plate defining a substantially planar member comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot;

wherein said liner receptor portion includes a flange for attaching said liner receptor portion to said corner plate;

and wherein said curved portion comprises a curved portion slot for receiving said corner plate.

11. The modular corner piece of claim 4, wherein said flange is attached to said corner plate using fasteners.

12. A modular corner piece for forming a corner of a pool, said pool including a sidewall having a pool liner receptor slot for receiving a pool liner, said modular corner piece comprising:

a corner plate defining a substantially planar member comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot;

wherein said first side and said second side of said corner plate each comprise a shoulder;

wherein said curved portion extends beyond said shoulders; and wherein said curved portion comprises a curved portion slot for receiving said corner plate.

13. A modular corner piece for forming a corner of a pool, said modular corner piece comprising:

a corner plate comprising a first side and a second side; and a curved portion including a liner receptor portion for receiving a pool liner;

wherein said liner receptor portion includes a flange for attaching said liner receptor portion to said corner plate; and wherein said liner receptor portion comprises a top wall and a bottom wall defining a channel therebetween, and wherein said channel has a depth that is greater than a thickness of said channel between said top wall and said bottom wall;

and wherein said curved portion comprises a curved portion slot for receiving said corner plate.

14. The modular corner piece of claim 13, wherein said flange is attached to said corner plate using fasteners.

15. The modular corner piece of claim 13, wherein said first side of said corner plate is disposed at a right angle with respect to said second side.

16. The modular corner piece of claim 15, wherein said curved portion extends between said first side and said second side.

17. The modular corner piece of claim 13, wherein said corner plate forms a substantially planar member.

18. The modular corner piece of claim 13, wherein said corner plate has an upper surface and a lower surface and wherein said liner receptor portion extends above said upper surface.

19. The modular corner piece of claim 13, wherein said channel extends from an upper surface of said corner plate to a lower surface of said corner plate.

20. The modular corner piece of claim 18, wherein said liner receptor portion extends below said lower surface.

21. A modular corner piece for forming a corner of a pool, said pool including a sidewall having a pool liner receptor slot for receiving a pool liner, said modular corner piece comprising:

a corner plate comprising a first side configured to fit within said slot, and a second side configured to fit within said slot; and a curved portion including a liner receptor portion for receiving said pool liner;

wherein when said first side and said second side of said corner plate are installed within said slot, said liner receptor portion is aligned with said slot;

wherein said first side and said second side of said corner plate each comprise a shoulder;

wherein said curved portion extends beyond said shoulders;

and wherein said curved portion comprises a curved portion slot for receiving said corner plate.

22. A system forming a corner of a pool, said system comprising:

a slot formed in a perimeter of said pool, said slot configured for receiving a pool liner;

a modular corner piece, said modular corner piece comprising a corner plate and a curved portion, said corner plate configured to be received within said slot such that said curved portion defines a corner of said pool.

23. The system of claim 22, wherein said curved portion is disposed on said corner plate in alignment with said slot.

24. The system of claim 22, wherein said slot is defined in a coping extending around said perimeter of said pool.

25. The system of claim 24, wherein said coping further comprises a track retainer for retaining a pool cover track for guiding an edge of a retractable pool cover.

26. The system of claim 25, wherein said coping further comprises a lighting channel for housing lighting devices.

27. The system of claim 25, wherein said coping defining said slot and said track retainer is formed of a single piece.

28. A system for forming a corner of a pool, said system comprising:

a coping for extending around a perimeter of said pool, said coping having a first linear side and a second linear side that come together at a coping corner, said coping comprising a pool liner receptor slot configured for receiving a pool liner;

a modular corner piece, said modular corner piece comprising a corner plate defining a substantially planar member comprising a first side configured to be received in said liner receptor slot in said first linear side of said coping and a second side configured to be received in said liner receptor slot in said second linear side of said coping, said first side of said corner plate and said second side of said corner plate intersecting at a corner point, said modular corner piece further comprising a curved portion including a liner receptor portion for receiving said pool liner;

wherein when said first side of said corner plate and said second side of said corner plate are inserted in said pool liner receptor slot at said coping corner, said curved portion is disposed in elevational alignment with said pool liner receptor slot;

wherein said liner receptor portion comprises a top wall and a bottom wall defining a channel therebetween;

wherein said liner receptor portion includes a flange for attaching said liner receptor portion to said corner plate;

wherein said flange is attached to said corner plate using fasteners;

wherein said first side of said corner plate is disposed at a right angle with respect to said second side of said corner plate;

wherein said curved portion extends between said first side of said corner plate and said second side of said corner plate;

wherein said first side of said corner plate and said second side of said corner plate each comprise a shoulder;

wherein said curved portion extends beyond said shoulders;

wherein said coping further comprises a track retainer for retaining a pool cover track for guiding an edge of a retractable pool cover;

wherein said coping defining said liner receptor slot and said track retainer is formed of a single piece; and wherein when said modular corner piece is installed in said coping, said pool liner receptor slot forms a continuous path with said liner receptor portion for receiving said pool liner.

29. A modular corner piece for forming a corner of a pool, said modular corner piece comprising:

a corner plate defining a substantially planar member comprising a first side and a second side, said first side and said second side intersecting at a corner point; and a curved portion including a liner receptor portion for receiving a pool liner;

wherein said curved portion extends between said first side and said second side wherein said liner receptor portion comprises a top wall and a bottom wall, and wherein a distance between a top surface of said top wall to a bottom surface of said bottom wall is greater than a thickness of said corner plate between an upper surface of said corner plate and a lower surface of said corner plate; and wherein said corner plate is solid throughout said thickness such that said corner plate extends from said top wall to said bottom wall through said thickness.

30. A modular corner piece for forming a corner of a pool, said pool including a sidewall having a pool liner receptor slot for receiving a pool liner, said modular corner piece comprising:

a corner plate defining a substantially planar member comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot;

wherein said corner plate comprises an upper surface defining an uppermost boundary of said corner plate, and a lower surface defining a lowermost boundary of said corner plate, and wherein at least one of said first side and said second side define a substantially continuous planar surface between said upper surface and said lower surface characterized by an absence of protrusions extending therefrom;

and wherein said curved portion comprises a curved portion slot for receiving said corner plate.

31. A modular corner piece for forming a corner of a pool, said modular corner piece comprising:

a corner plate comprising a first side and a second side; and a curved portion including a liner receptor portion for receiving a pool liner;

wherein said liner receptor portion comprises a top wall and a bottom wall, and wherein a distance between a top surface of said top wall to a bottom surface of said bottom wall is greater than a thickness of said corner plate between an upper surface of said corner plate and a lower surface of said corner plate; and wherein said corner plate is solid throughout said thickness;

and wherein said curved portion composes a curved portion slot for receiving said corner plate.

32. A modular corner piece for forming a corner of a pool, said pool including a sidewall having a pool liner receptor slot for receiving a pool liner, said modular corner piece comprising:

a corner plate comprising a first side configured to fit within said slot, and a second side configured to fit within said slot; and a curved portion including a liner receptor portion for receiving said pool liner;

wherein when said first side and said second side of said corner plate are installed within said slot, said liner receptor portion is aligned with said slot;

wherein said curved portion defines a concave curve;

and wherein said curved portion comprises a curved portion slot for receiving said corner plate.

33. A modular corner piece for forming a corner of a pool, said pool including a sidewall having a pool liner receptor slot for receiving a pool liner, said modular corner piece comprising:

a corner plate comprising a first side configured to fit within said slot, and a second side configured to fit within said slot; and a curved portion including a liner receptor portion for receiving said pool liner;

wherein when said first side and said second side of said corner plate are installed within said slot, said liner receptor portion is aligned with said slot;

wherein said corner plate comprises an upper surface defining an uppermost boundary of said corner plate, and a lower surface defining a lowermost boundary of said corner plate, and wherein at least one of said first side and said second side define a substantially continuous planar surface between said upper surface and said lower surface characterized by an absence of protrusions extending therefrom;

and wherein said curved portion comprises a curved portion slot for receiving said corner plate.

34. A modular corner piece for forming a corner of a pool, said pool including a sidewall having a pool liner receptor slot for receiving a pool liner, said modular corner piece comprising:

a corner plate defining a substantially planar member comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot;

wherein said liner receptor portion includes a flange for attaching said liner receptor portion to said corner plate; and wherein said liner receptor portion comprises a top wall and a bottom wall defining a channel therebetween, and wherein said channel has a depth that is greater than a thickness of said channel between said top wall and said bottom wall.

35. A modular corner piece for forming a corner of a pool, said pool including a sidewall having a pool liner receptor slot for receiving a pool liner, said modular corner piece comprising:

a corner plate defining a substantially planar member comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot;

wherein said first side and said second side of said corner plate each comprise a shoulder;

wherein said curved portion extends beyond said shoulders; and wherein said liner receptor portion comprises a top wall and a bottom wall defining a channel therebetween, and wherein said channel has a depth that is greater than a thickness of said channel between said top wall and said bottom wall.

36. A modular corner piece for forming a corner of a pool, said pool including a sidewall having a pool liner receptor slot for receiving a pool liner, said modular corner piece comprising:

a corner plate defining a substantially planar member comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot;

wherein said corner plate comprises an upper surface defining an uppermost boundary of said corner plate, and a lower surface defining a lowermost boundary of said corner plate, and wherein at least one of said first side and said second side define a substantially continuous planar surface between said upper surface and said lower surface characterized by an absence of protrusions extending therefrom; and wherein said liner receptor portion comprises a top wall and a bottom wall defining a channel therebetween, and wherein said channel has a depth that is greater than a thickness of said channel between said top wall and said bottom wall.

* * * * *

US007114297C1

(12) EX PARTE REEXAMINATION CERTIFICATE (7915th)

United States Patent
Mathis et al.

(10) Number: US 7,114,297 C1
(45) Certificate Issued: Dec. 7, 2010

(54) RADIUS CORNER PLATE FOR A POOL

(75) Inventors: Wesley L. Mathis, Draper, UT (US); David B. Dalton, Heber City, UT (US)

(73) Assignee: Pool Cover Specialists National, Inc., West Jordan, UT (US)

Reexamination Request:
No. 90/010,593, Jul. 7, 2009

Reexamination Certificate for:

| | |
|---|---|
| Patent No.: | **7,114,297** |
| Issued: | **Oct. 3, 2006** |
| Appl. No.: | **10/347,161** |
| Filed: | **Jan. 16, 2003** |

Related U.S. Application Data

(60) Provisional application No. 60/361,187, filed on Feb. 28, 2002, and provisional application No. 60/349,894, filed on Jan. 16, 2002.

(51) Int. Cl.
*E02D 27/00* (2006.01)

(52) U.S. Cl. ..... 52/169.7; 4/488; 4/496; 4/503; 52/102; 52/287.1

(58) Field of Classification Search ..... None
See application file for complete search history.

(56) References Cited

U.S. PATENT DOCUMENTS

| | | | |
|---|---|---|---|
| 1,782,147 | A | 11/1930 | Merryweather |
| 3,950,907 | A | 4/1976 | Dahowski |
| 3,974,605 | A | 8/1976 | Beatty et al. |
| 4,459,119 | A | 7/1984 | Beijer |
| 5,333,428 | A | 8/1994 | Taylor et al. |
| 5,454,195 | A | 10/1995 | Hallsten |
| 5,680,730 | A | 10/1997 | Epple |
| 6,390,680 | B1 | 5/2002 | Last |
| 6,418,572 | B1 | 7/2002 | Epple et al. |
| 6,496,990 | B2 | 12/2002 | Last |

OTHER PUBLICATIONS

FOXXX Installation Manual 1 for Pool & Reel Box SA–938, Aug. 1, 2000, 32 pages.

Wardell, Randy and Judy, Introduction to Stained Glass: A Teaching Manual, 1985, Wardell Publications, Houston, Texas, 40 pages.

*Primary Examiner*—Peter C. English

(57) ABSTRACT

A modular rounded corner piece for forming rounded corners of a pool. The modular rounded corner piece may include a plate portion and a liner receptor portion. The liner receptor portion may include a channel formed by a top wall and a bottom wall. The channel may align with a pool liner receptor slot in the coping around the perimeter of the pool. Thus, a continuous liner receptor slot may be formed around the interior circumference of the pool for receiving an edge of a pool liner thereinto. The modular rounded corner piece may be installed on the pool sidewall to provide a gapless alignment between the liner receptor on the pool sidewall and the liner receptor in the rounded side of the corner plate.

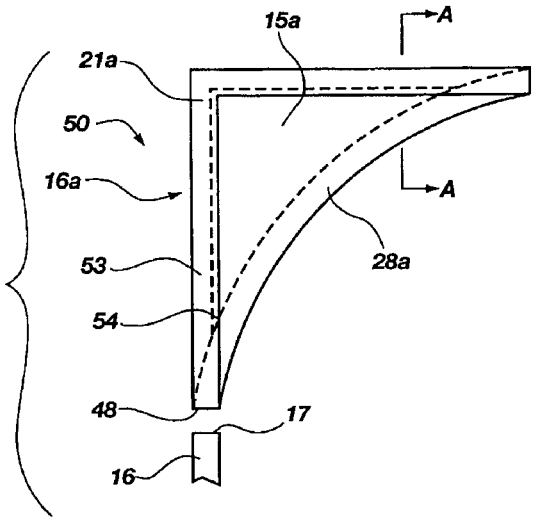

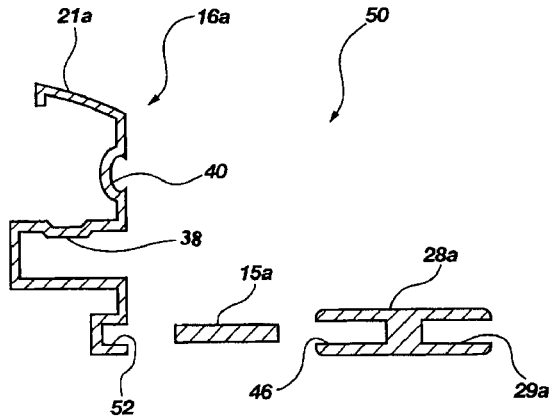

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10, 12, 21-28, 30, 32 and 33 is confirmed.

Claims 34 and 36 are cancelled.

Claims 1, 7, 8, 11, 13, 29, 31 and 35 are determined to be patentable as amended.

Claims 2-6, 9 and 14-20, dependent on an amended claim, are determined to be patentable.

New claims 37 and 38 are added and determined to be patentable.

1. A modular corner piece for forming a corner of a pool, said modular corner piece comprising:

a corner plate defining a substantially planar member comprising a first side and a second side, said first side and said second side intersecting at a corner point; and a curved portion including a liner receptor portion for receiving a pool liner;

wherein said curved portion extends between said first side and said second side;

wherein said curved portion defines a concave curve; and wherein said liner receptor portion comprises a top wall and a bottom wall defining a channel therebetween, and wherein said channel has a depth that is greater than a thickness of said channel between said top wall and said bottom wall*; and*

*a corner coping member comprising a first side coping member and a second side coping member forming a corner; and*

*a track retainer formed in the corner coping member, the track retainer adapted to receive a pool cover track for guiding a pool cover;*

*wherein said corner plate extends between the first side coping member and said second side coping member of the corner coping member below the track retainer.*

7. The modular corner piece of claim 4, [further comprising a] *wherein said corner coping member is* substantially rigid [coping portion for aligning] *and aligns* with said coping end to form a coping corner.

8. The modular corner piece of claim 4, *wherein said first side coping member* further [comprising] *comprises* a linear coping portion for aligning with said coping end, said liner receptor being aligned with said linear coping portion at said at least one end and curving away from said linear portion.

11. The modular corner piece of claim [4] *10*, wherein said flange is attached to said corner plate using fasteners.

13. A modular corner piece for forming a corner of a pool, *said pool including a sidewall having a pool liner receptor slot for receiving a pool liner,* said modular corner piece comprising:

a corner plate comprising a first side and a second side; and a curved portion including a liner receptor portion for receiving [a] *said* pool liner;

wherein said liner receptor portion includes a flange for attaching said liner receptor portion to said corner plate; and wherein said liner receptor portion comprises a top wall and a bottom wall defining a channel therebetween, and wherein said channel has a depth that is greater than a thickness of said channel between said top wall and said bottom wall;

and wherein said curved portion comprises a curved portion slot for receiving said corner plate*;*

*wherein said liner receptor portion is aligned with said pool liner receptor slot when said corner plate is installed in said pool sidewall.*

29. A modular corner piece for forming a corner of a pool, said modular corner piece comprising:

a corner plate defining a substantially planar member comprising a first side and a second side, said first side and said second side intersecting at a corner point; and a curved portion including a liner receptor portion for receiving a pool liner;

wherein said curved portion extends between said first side and said second side*;* wherein said liner receptor portion comprises a top wall and a bottom wall, and wherein a distance between a top surface of said top wall to a bottom surface of said bottom wall is greater than a thickness of said corner plate between an upper surface of said corner plate and a lower surface of said corner plate; and wherein said corner plate is solid throughout said thickness such that said corner plate extends from said top wall to said bottom wall through said thickness*; and*

*a corner coping member comprising a first side coping member and a second side coping member forming a corner; and*

*a track retainer formed in the corner coping member, the track retainer adapted to receive a pool cover track for guiding a pool cover;*

*wherein said corner plate extends between the first side coping member and said second side coping member of the corner coping member below the track retainer.*

31. A modular corner piece for forming a corner of a pool, said modular corner piece comprising:

a corner plate comprising a first side and a second side; and a curved portion including a liner receptor portion for receiving a pool liner;

wherein said liner receptor portion comprises a top wall and a bottom wall, and wherein a distance between a top surface of said top wall to a bottom surface of said bottom wall is greater than a thickness of said corner plate between an upper surface of said corner plate and a lower surface of said corner plate; and wherein said corner plate is solid throughout said thickness *such that said corner plate extends from said top wall to said bottom wall through said thickness*;

and wherein said curved portion [composes] *comprises* a curved portion slot for receiving said corner plate*; and*

*a corner coping member comprising a first side coping member and a second side coping member forming a corner; and*

*a track retainer formed in the corner coping member, the track retainer adapted to receive a pool cover track for guiding a pool cover;*

*wherein said corner plate extends between the first side coping member and said second side coping member of the corner coping member below the track retainer.*

35. A modular corner piece for forming a corner of a pool, said pool including a sidewall having a pool liner receptor slot for receiving a pool liner *and a track retainer adapted to receive a pool cover track for guiding a pool cover*, said modular corner piece comprising:

a corner plate defining a substantially planar member *having an upper surface and a lower surface, the corner plate further* comprising a first side and a second side, said first side and said second side intersecting at a corner point; and a curved portion including a liner receptor portion for receiving said pool liner;

wherein said curved portion extends between said first side and said second side such that when said corner plate is installed in said pool sidewall, said liner receptor portion is aligned with said pool liner receptor slot *and said corner plate resides below said track retainer*;

wherein said first side and said second side of said corner plate each comprise a shoulder *extending between the upper surface and the lower surface of the corner plate and defining an end of the corner plate*;

wherein said curved portion extends beyond *each of* said shoulders *such that the liner receptor portion extends a distance beyond said shoulders*; and wherein said liner receptor portion comprises a top wall and a bottom wall defining a channel therebetween, and wherein said channel has a depth that is greater than a thickness of said channel between said top wall and said bottom wall.

*37. A modular corner piece for forming a corner of a pool, said modular corner piece comprising:*

*a corner plate comprising a first side and a second side; and*

*a curved portion including a liner receptor portion for receiving a pool liner;*

*wherein said liner receptor portion includes a flange for attaching said liner receptor portion to said corner plate; and*

*wherein said liner receptor portion comprises a top wall and a bottom wall defining a channel therebetween, and*

*wherein said channel has a depth that is greater than a thickness of said channel between said top wall and said bottom wall; and*

*wherein said curved portion comprises a curved portion slot for receiving said corner plate;*

*a corner coping member comprising a first side coping member and a second side coping member forming a corner; and*

*a track retainer formed in the corner coping member, the track retainer adapted to receive a pool cover track for guiding a pool cover;*

*wherein said corner plate extends between the first side coping member and said second side coping member of the corner coping member below the track retainer.*

*38. A system for forming a corner of a pool, said system comprising:*

*a modular corner piece comprising a corner plate and a curved portion, said corner plate defining a substantially planar member comprising a first side and a second side, said first side and said second side intersecting at a corner point; and*

*said curved portion including a liner receptor portion for receiving a pool liner;*

*wherein said curved portion extends between said first side and said second side;*

*wherein said curved portion defines a concave curve;*

*and wherein said liner receptor portion comprises a top wall and a bottom wall defining a channel therebetween, and wherein said channel has a depth that is greater than a thickness of said channel between said top wall and said bottom wall; and*

*a corner coping member comprising a first side coping member and a second side coping member forming a corner; and*

*a track retainer formed in the corner coping member, the track retainer adapted to receive a pool cover track for guiding a pool cover;*

*wherein said corner plate extends between the first side coping member and said second side coping member of the corner coping member below the track retainer.*

* * * * *